US012722838B2

(12) United States Patent
Hong et al.

(10) Patent No.: US 12,722,838 B2
(45) Date of Patent: Sep. 1, 2026

(54) ELECTRONIC DEVICE CARRIER TRAY

(71) Applicant: YOKE INDUSTRIAL CORP., Taichung City (TW)

(72) Inventors: Rong-Der Hong, Taichung City (TW); Thomas Lin, Changhua County (TW); Kai-Jen Ke, Taichung City (TW)

(73) Assignee: YOKE INDUSTRIAL CORP., Taichung City (TW)

( * ) Notice: Subject to any disclaimer, the term of this patent is extended or adjusted under 35 U.S.C. 154(b) by 0 days.

(21) Appl. No.: 19/001,353

(22) Filed: Dec. 24, 2024

(65) Prior Publication Data

US 2026/0048890 A1 Feb. 19, 2026

(30) Foreign Application Priority Data

Aug. 15, 2024 (TW) ..... 113130735

(51) Int. Cl.
*B65D 1/36* (2006.01)
*B65D 85/68* (2006.01)

(52) U.S. Cl.
CPC ..... *B65D 1/36* (2013.01); *B65D 85/68* (2013.01)

(58) Field of Classification Search
CPC . B65D 1/36; B65D 85/68; B65D 1/34; B65D 77/30; B65D 85/42; B65D 2590/0083
USPC ..... 206/702–728
See application file for complete search history.

(56) References Cited

U.S. PATENT DOCUMENTS 2,310,464 A * 2/1943 Sanford ..... B65D 77/20 217/26
3,040,923 A * 6/1962 Leitzel ..... B65D 85/34 206/521.1
3,197,058 A * 7/1965 Hale ..... B65D 21/046 D9/755
3,281,003 A * 10/1966 Pesut, Jr. ..... B65D 1/36 206/521.1
3,896,239 A * 7/1975 Peters ..... B65D 1/36 426/119
2009/0151247 A1* 6/2009 Kirtz ..... B65D 21/0204 47/87
2011/0132789 A1* 6/2011 Peng ..... B65D 1/36 206/505
2024/0067387 A1* 2/2024 Otte ..... B65D 77/04

* cited by examiner

*Primary Examiner* — Chun Hoi Cheung
(74) *Attorney, Agent, or Firm* — Apex Juris, pllc; Cera Oh

(57) ABSTRACT

An electronic device carrier tray, comprising a tray body, wherein the tray body has a plurality of support ribs, and the plurality of support ribs are spaced apart and parallel; a restriction direction is defined on the tray body, and the restriction direction is perpendicular to the plurality of support ribs; the tray body has a plurality of accommodating portions between any two adjacent support ribs of the plurality of support ribs, and the tray body has a plurality of pickup grooves between any two adjacent support ribs of the plurality of support ribs; two sides of each accommodating portion respectively communicate with two pickup grooves of the plurality of pickup grooves, and a maximum aperture of each pickup groove in the restriction direction is greater than a maximum length of each accommodating portion in the restriction direction.

5 Claims, 15 Drawing Sheets

ELECTRONIC DEVICE CARRIER TRAY

BACKGROUND OF THE INVENTION

Technical Field

The present invention relates generally to a carrier tray; and more particularly to a carrier tray with pickup grooves on both sides of an accommodating portion so that the user can easily take an electronic device from the carrier tray out or put the electronic device in the carrier tray.

Description of Related Art

Existing carrier trays for electronic devices are mainly made of plastic materials, and the body of the carrier tray is durable and lightweight. The surface of the carrier tray has a plurality of grooves corresponding to the size of the electronic device. The plurality of grooves can accommodate electronic devices respectively, so that the plurality of electronic devices is spaced apart on the carrier tray. When the electronic devices are transported with the carrier tray, the electronic devices can be prevented from being vibrated and damaged.

The above-mentioned existing carrier tray can accommodate electronic devices and is convenient for transporting the electronic devices; However, since the carrier tray only has grooves for accommodating electronic devices, it is difficult for the user to pick up or transfer the electronic devices from the carrier tray. When the device is placed in the carrier tray, it is difficult to directly take out the electronic device from the groove, or to accurately place the electronic device into the groove, which consumes the user's time.

BRIEF SUMMARY OF THE INVENTION

In view of the above, the primary objective of the present invention is to provide a carrier tray that has a plurality of accommodating portions for accommodating electronic devices, and a periphery of each of the plurality of accommodating portions has a structure that does not hinder fingers from picking up the electronic devices or putting the electronic devices into the plurality of accommodating portions, so that users can smoothly and quickly put the electronic devices in the carrier tray or taking the electronic devices from the carrier tray.

The present invention provides an electronic device carrier tray, comprising a tray body, wherein the tray body has a plurality of support ribs, and the plurality of support ribs are spaced apart and parallel; a restriction direction is defined on the tray body, and the restriction direction is perpendicular to the plurality of support ribs; the tray body has a plurality of accommodating portions between any two adjacent support ribs of the plurality of support ribs, and the tray body has a plurality of pickup grooves between any two adjacent support ribs of the plurality of support ribs; two sides of each accommodating portion respectively communicate with two pickup grooves of the plurality of pickup grooves, and a maximum aperture of each pickup groove in the restriction direction is greater than a maximum length of each accommodating portion in the restriction direction.

When using the electronic device carrier tray of the present invention, the user places a plurality of electronic products into the respective of the plurality of accommodating portions of the electronic device carrier tray for positioning, and places each electronic product into the position of each of the plurality of accommodating portions.

During the process, two pickup grooves of the plurality of pickup grooves on both sides of each accommodating portion can accommodate the user's fingertips, preventing the user's fingers from being obstructed, allowing the user to quickly put various electronic products into each accommodating portions of the electronic device carrier tray, or taking out the electronic products stored therein from each accommodating portion.

BRIEF DESCRIPTION OF THE SEVERAL VIEWS OF THE DRAWINGS

The present invention would be best understood by referring to the following detailed description of some illustrative embodiments in conjunction with the accompanying drawings, in which.

DETAILED DESCRIPTION OF THE INVENTION

Figure 1:
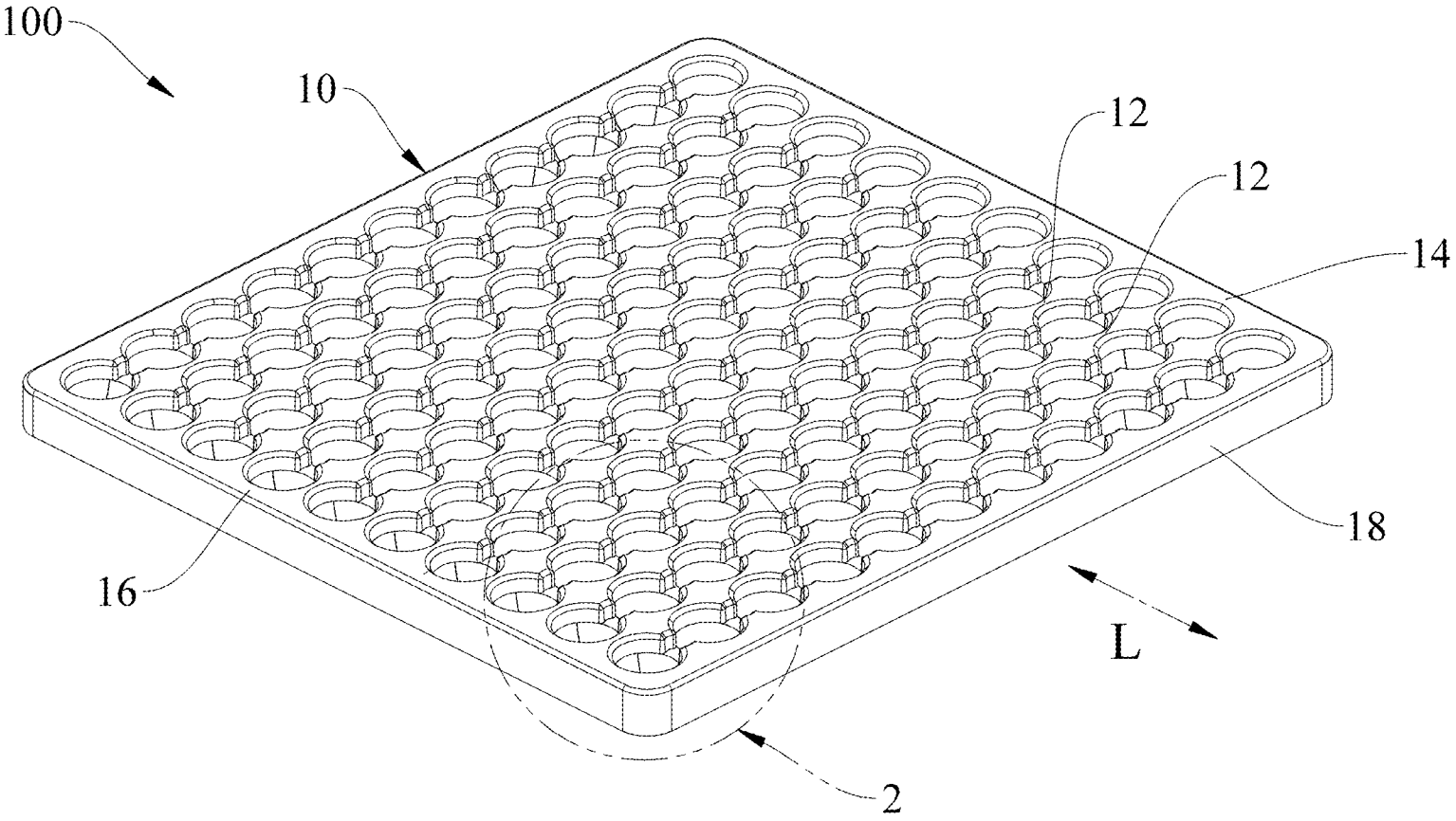
FIG. 1 is a perspective view of a first preferred embodiment of the present invention.
Figure 2:
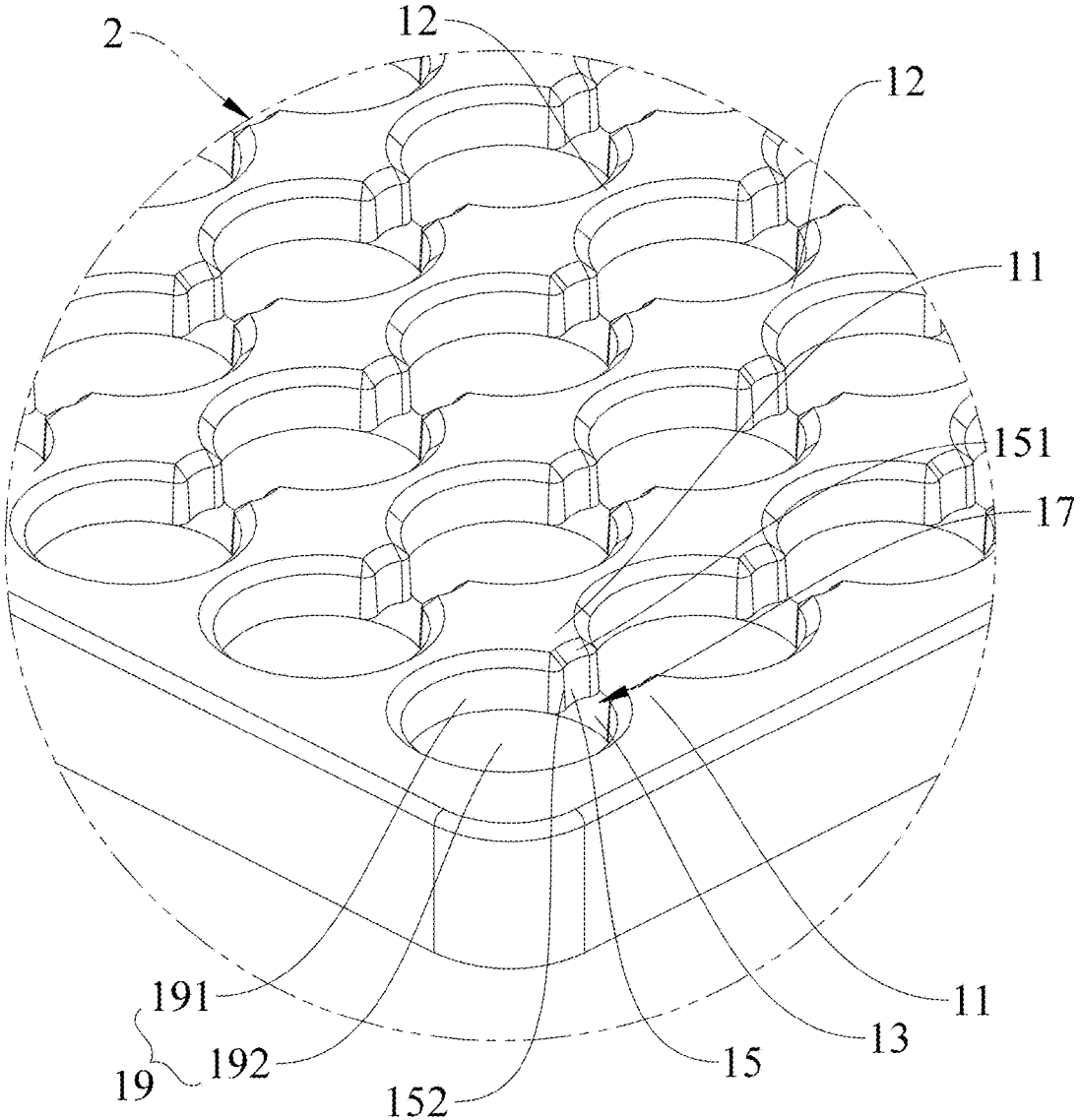
FIG. 2 is an enlarged view of a marked region 2 in FIG. 1.

Please refer to FIG. 1 to FIG. 6, which shows an electronic device carrier tray 100 of a first preferred embodiment of the present invention. The electronic device carrier tray 100 is used to carry electronic products, such as particles embedded with radio frequency identification tag chips.

The electronic device carrier tray 100 has a tray body 10. The tray body 10 can be a solid tray made of plastic or composite materials, or a shell made of the plastic or composite materials. In this preferred embodiment, the tray body 10 is a plastic shell, and the tray body 10 has eleven support ribs 12. The support ribs 12 are spaced apart and parallel. A restriction direction L is defined on the tray body 10. The restriction direction L is perpendicular to a direction in which the support ribs 12 extend.

Each support rib 12 has two ends, and one of the two ends of each support rib 12 is connected to a first rib 14, and the other end of each support rib 12 is connected to a second rib 16. A side wall 18 is formed around the tray body 10, and the side wall 18 is connected with the first rib 14 and the second rib 16. In other preferred embodiments, the number of the support ribs 12 can also be two, three or more.

A plurality of pairs of convex portions 11 protrudes from any two adjacent support ribs 12, and a supporting surface 13 is formed on a bottom side between two convex portions 11 of each pair of convex portions 11. Two restriction surfaces 15 are respectively formed on two opposite surfaces of two convex portions 11 in each pair of convex portions 11, a central portion of each restriction surface 15 is more concave than two parts on two sides of each restriction surface 15, and a top edge of each restriction surface 15 forms a chamfer 151. An accommodating portion 17 is formed between the two restriction surfaces 15 and the supporting surface 13 of each pair of convex portions 11. Each accommodating portion 17 is used to accommodate the above-mentioned electronic products. Between any two adjacent support ribs 12, there are also a plurality of pickup grooves 19. Two of the plurality of pickup grooves 19 communicate with two sides of each accommodation portion 17. A portion of each restriction surface 15 adjacent to each pickup groove 19 forms a rounded corner portion 152.

In this preferred embodiment, each restriction surface 15 is an arcuate surface, and any two opposite restriction surfaces 15 surround to form an imaginary electronic device shape P. Each electronic device shape P is a cylindrical three-dimensional area, and two sides of each electronic device shape P extend into two of the plurality of pickup grooves 19 communicating with each accommodating portion 17. In this way, when an electronic product having a shape similar to a shape of each electronic device shape P is placed and positioned in the electronic device shape P, two sides of the electronic product will also extend into the two of the plurality of pickup grooves 19 communicating with each accommodating portion 17. Each pickup groove 19 is circular, and each pickup groove 19 forms two arcuate surfaces 191 opposite to each other. A recess 192 is connected between two bottom edges of the two arcuate surfaces 191. Two sides of each supporting surface 13 are connected to two edges of the two recesses 192 of two of the plurality of pickup grooves 19 communicating with each accommodating portion 17. A maximum aperture H1 of each pickup groove 19 along the restriction direction L is greater than a maximum length H2 of each accommodating portion 17 along the restriction direction L. That is to say, in this preferred embodiment, a diameter of each pickup groove 19 is greater than a length between two centers of the two opposite restriction surfaces 15.

In the above-mentioned first preferred embodiment, each receiving portion 17 is formed between each pair of convex portions 11. In other embodiments, a plurality of convex portions 11 can be formed by protruding from only one of any two adjacent support ribs 12, and an accommodation portion 17 is formed between each convex portion 11 of the support rib 12 and the other support rib 12. Therefore, a plurality of accommodating portions 17 is formed between the two adjacent support ribs 12, and the maximum length H2 of each accommodating portion 17 along the restriction direction L is also smaller than the maximum aperture H1 of each pickup groove 19 along the restriction direction L.

Referring to FIG. 7 to FIG. 10, when the above-mentioned electronic device carrier tray 100 of the present invention is used to carry electronic devices, such as particles embedded with radio frequency identification tag chips (hereinafter referred to as RFID particles), an RFID particle 20 is placed into one of the plurality of accommodating portions 17. The RFID particle 20 is generally a cylindrical elastomer. When a user holds two sides of the RFID particle 20 with his index finger and thumb and puts the RFID particle 20 into one of the plurality of accommodating portions 17, the RFID particle 20 is guided by the two chamfers 151 on the two sides of one of the plurality of accommodating portions 17, so that the RFID particle 20 can enter one of the plurality of accommodating portions 17 smoothly, and the RFID particle 20 is placed on one of the supporting surfaces 13 and positioned between two of the restriction surfaces 15.

Figure 3:
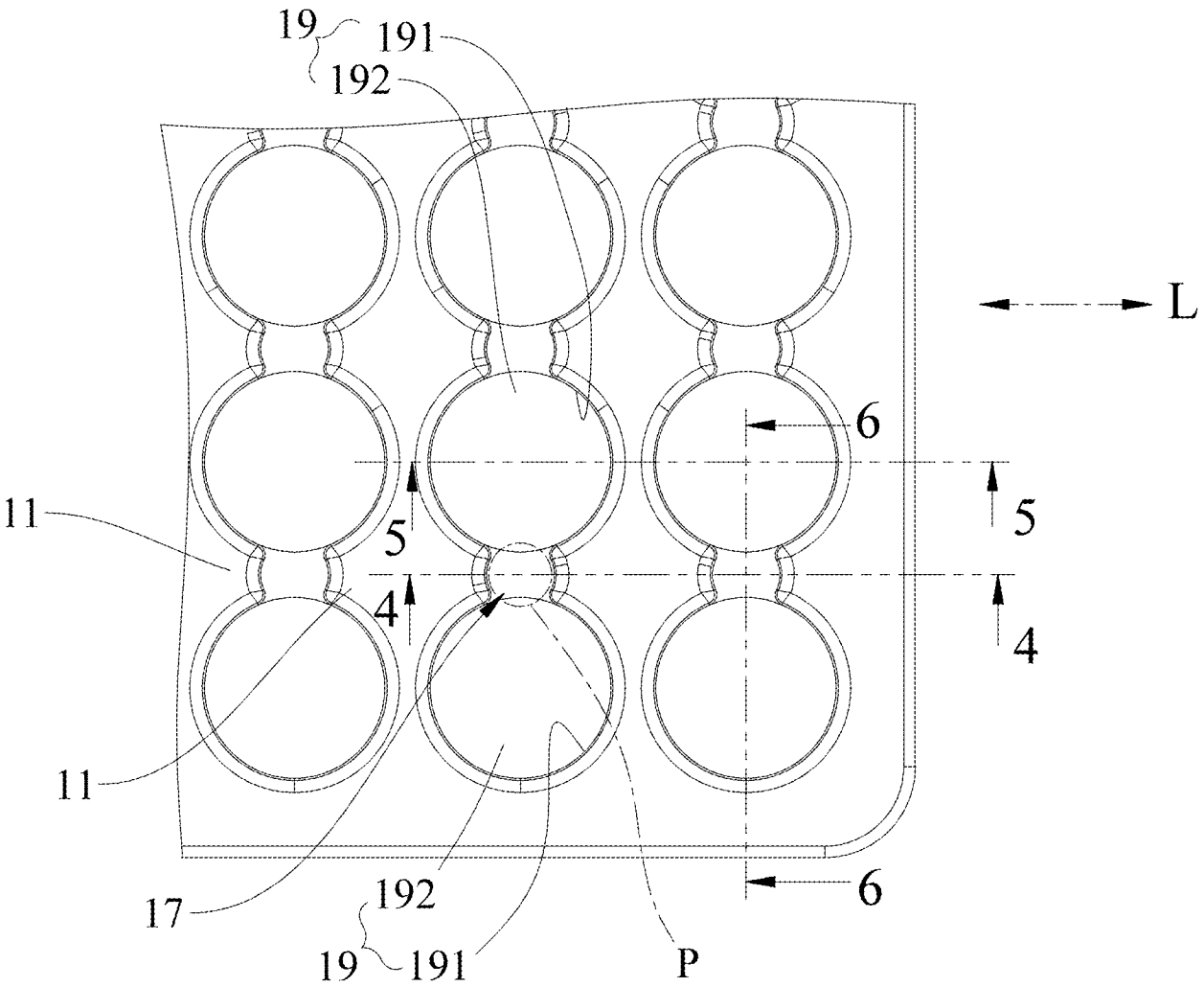
FIG. 3 is a partially enlarged top view of the first preferred embodiment of the present invention.
Figure 4:
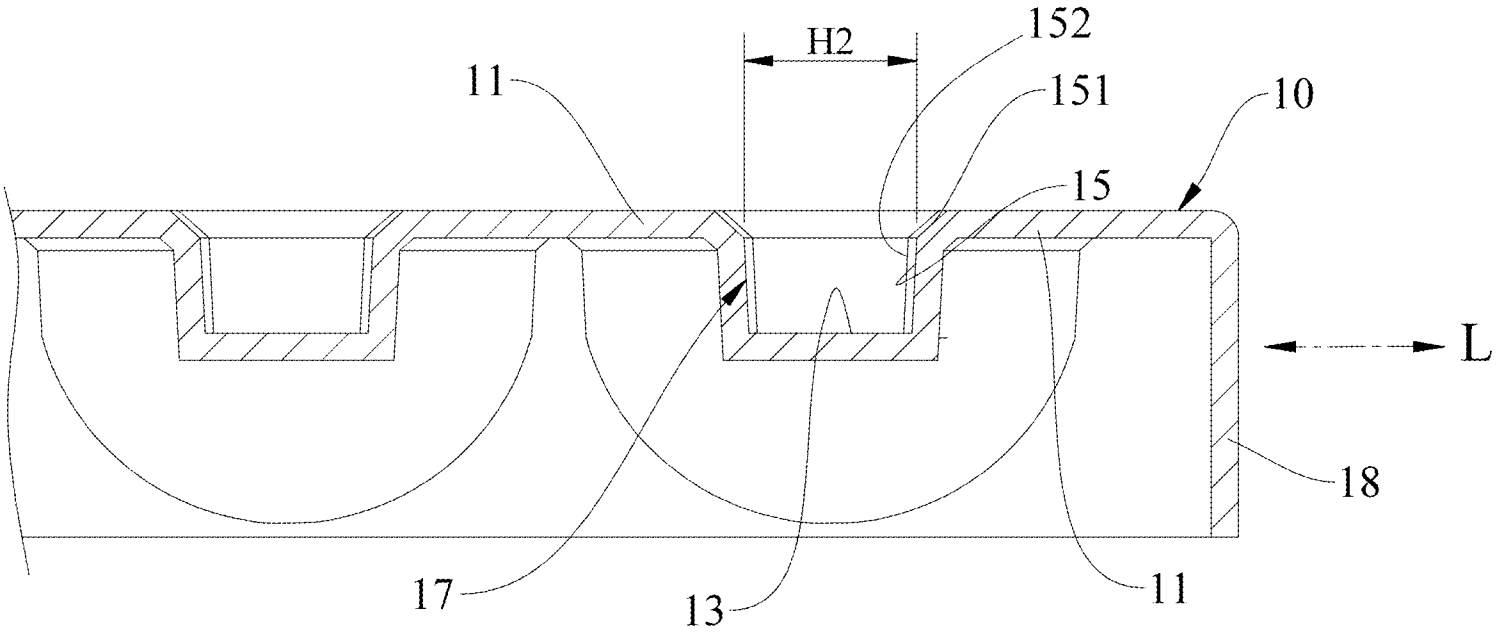
FIG. 4 is a sectional schematic view along the 4-4 line in FIG. 3.
Figure 5:
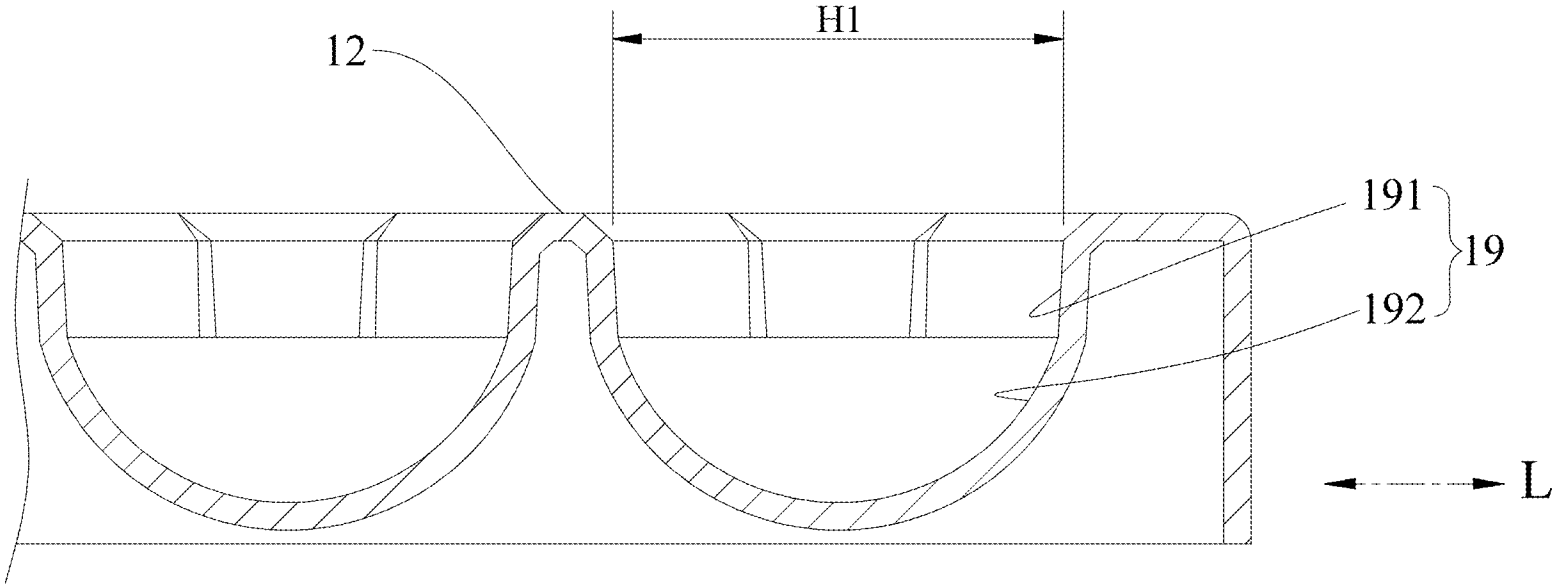
FIG. 5 is a sectional schematic view along the 5-5 line in FIG. 3.
Figure 6:
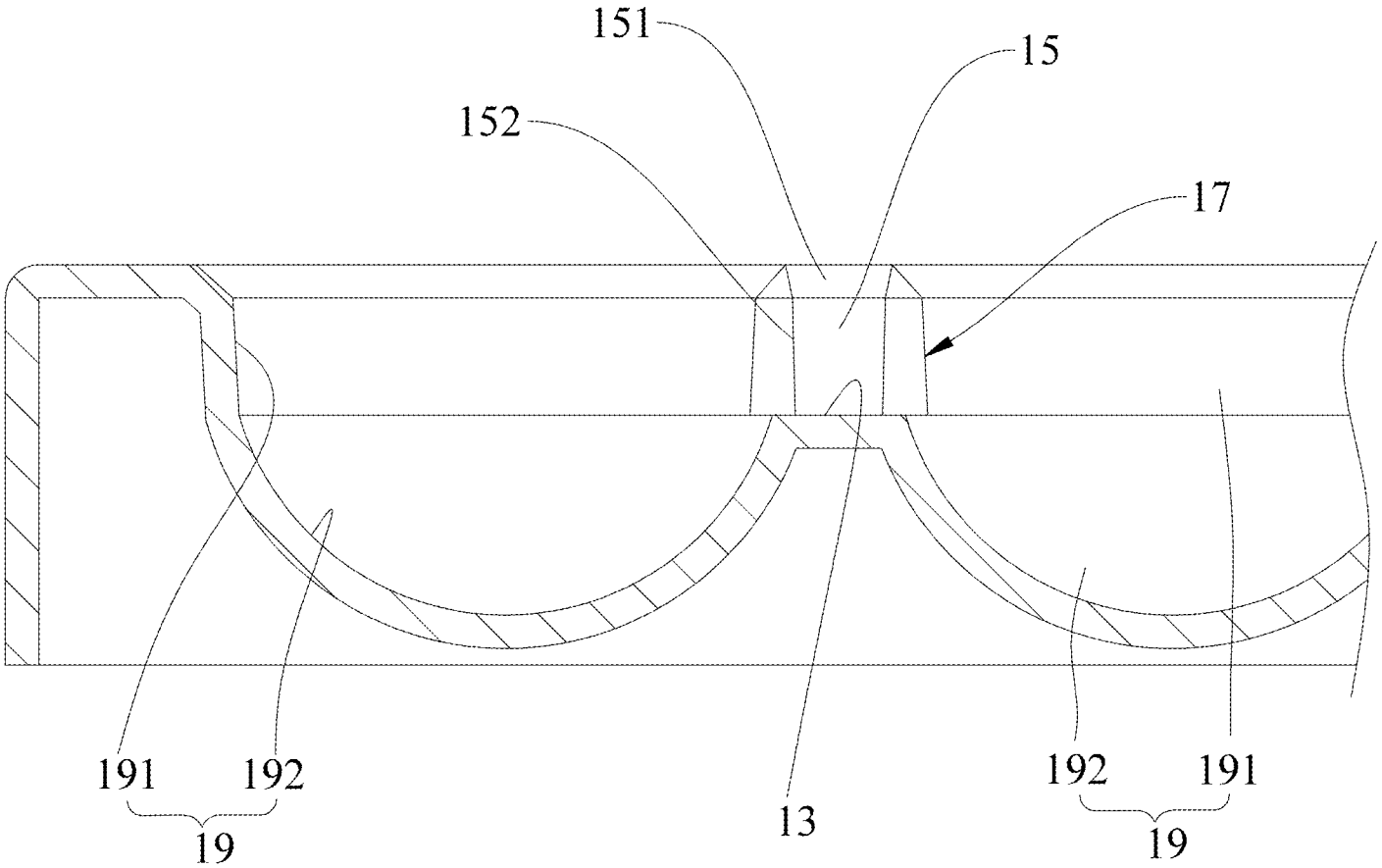
FIG. 6 is a sectional schematic view along the 6-6 line in FIG. 3.
Figure 7:
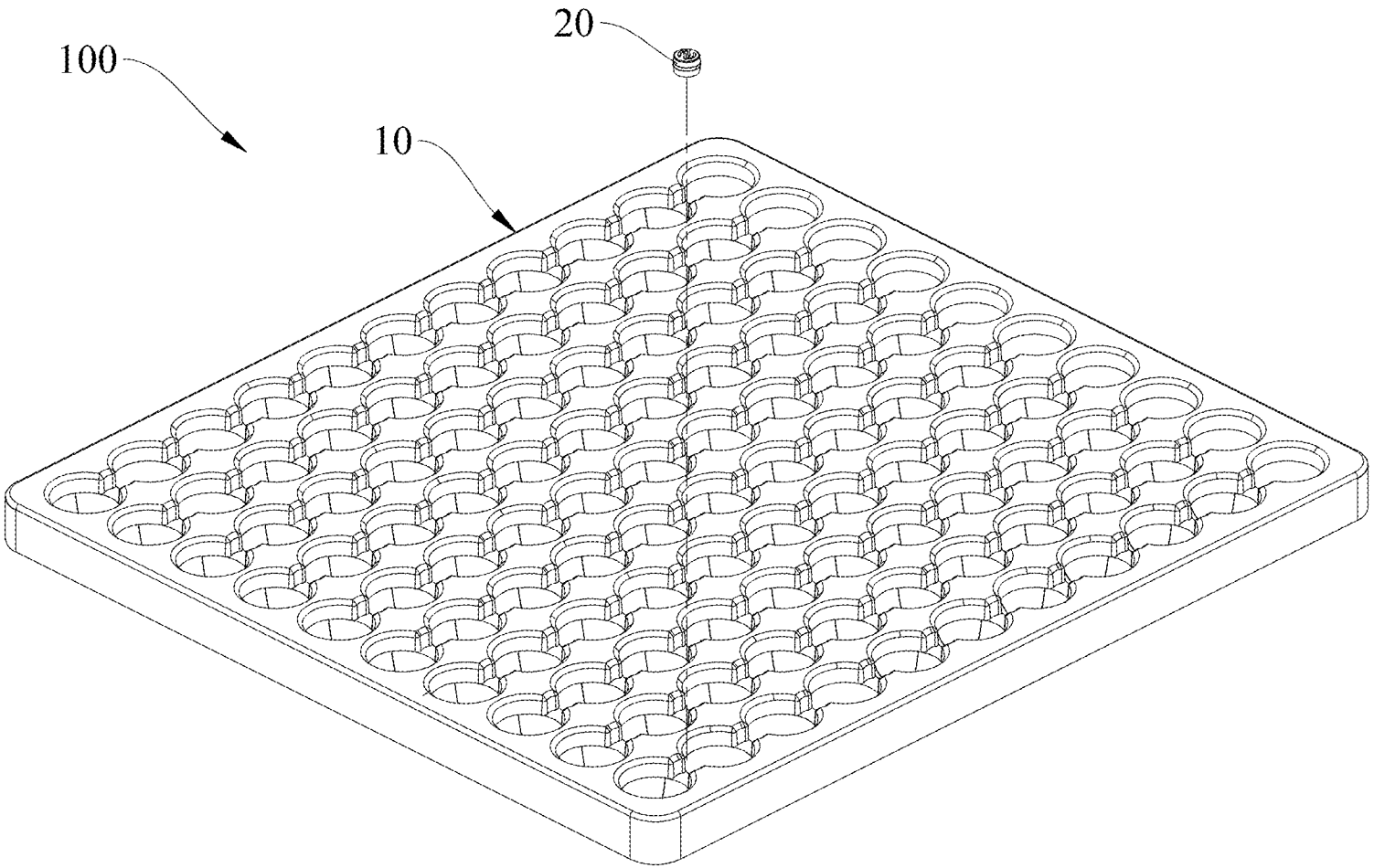
FIG. 7 is an exploded perspective view of the first preferred embodiment of the present invention for positioning a RFID particle into a tray body.
Figure 8:
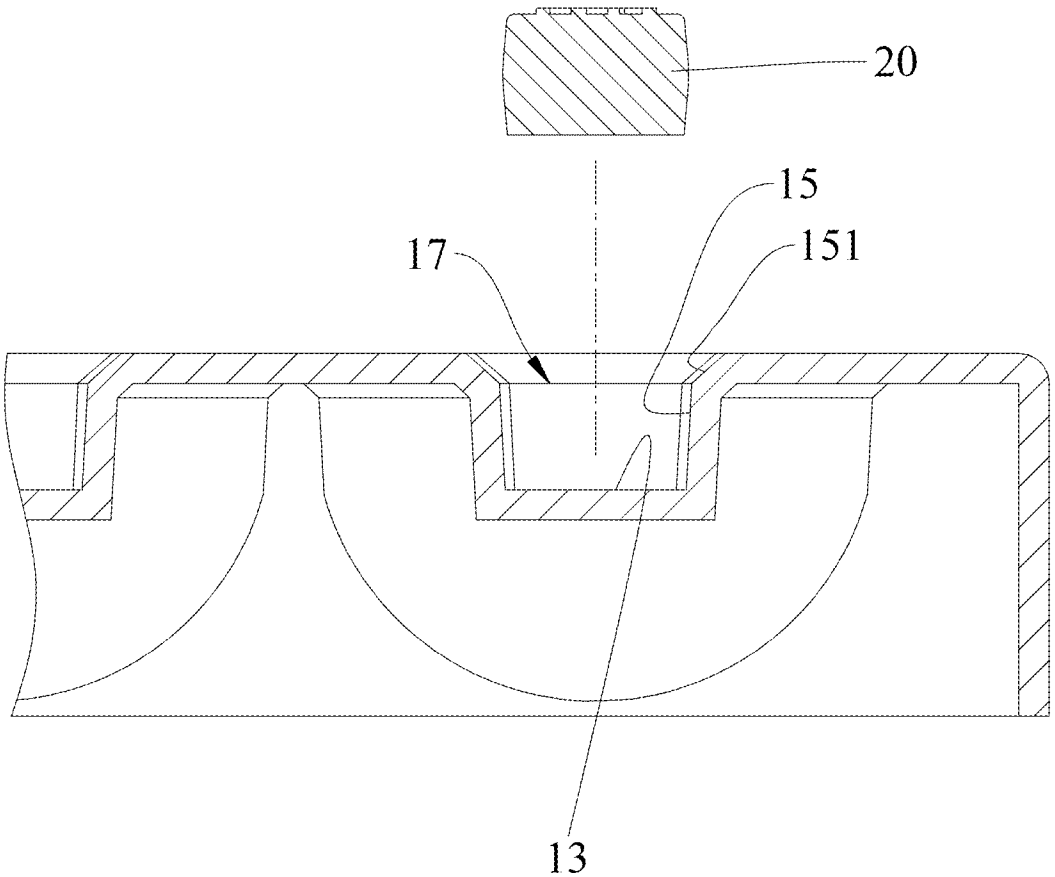
FIG. 8 is a sectional schematic view of the first preferred embodiment of the present invention for positioning the RFID particle into an accommodating portion.
Figure 9:
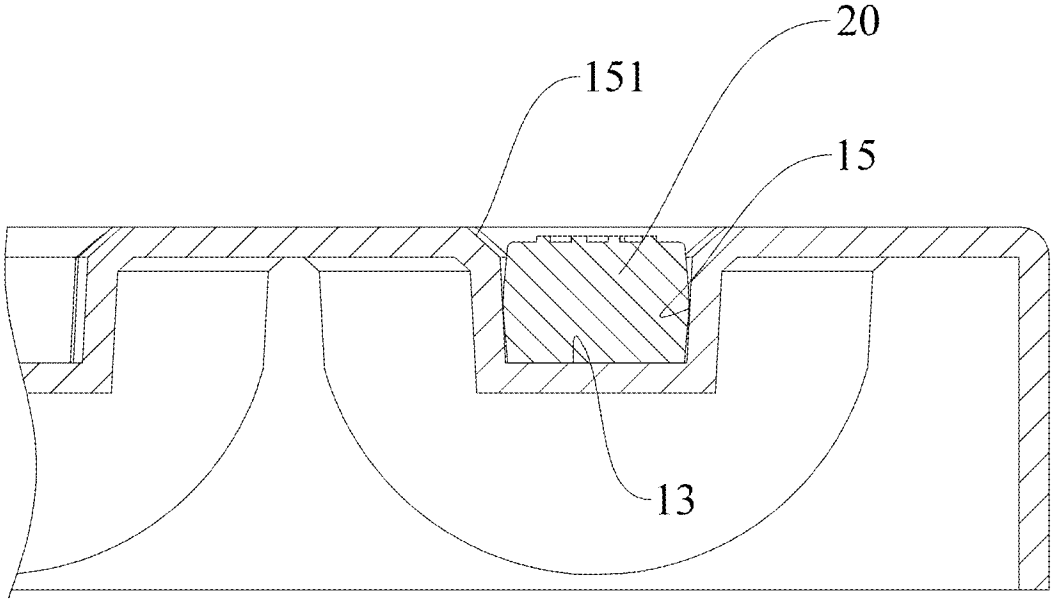
FIG. 9 is a sectional schematic view of the RFID particles inserted into the first preferred embodiment of the present invention.
Figure 10:
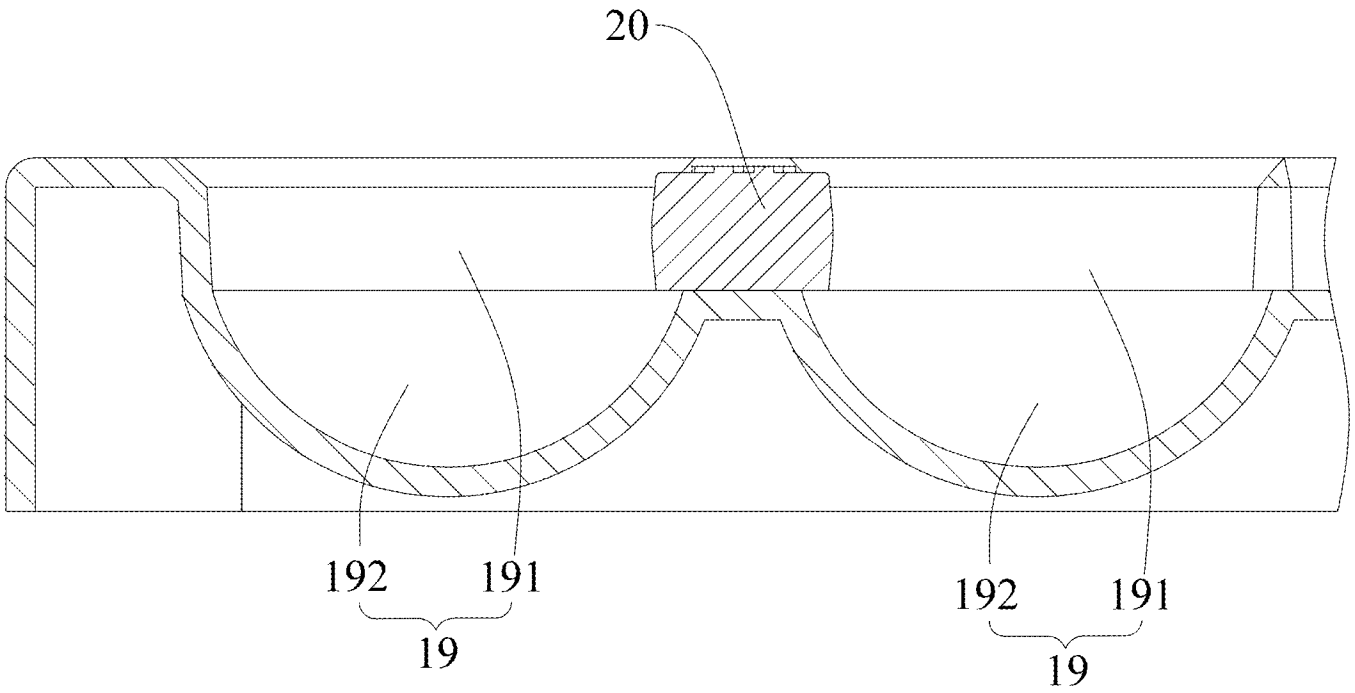
FIG. 10 is a sectional schematic view of the RFID particles placed in FIG. 6.
Figure 11:
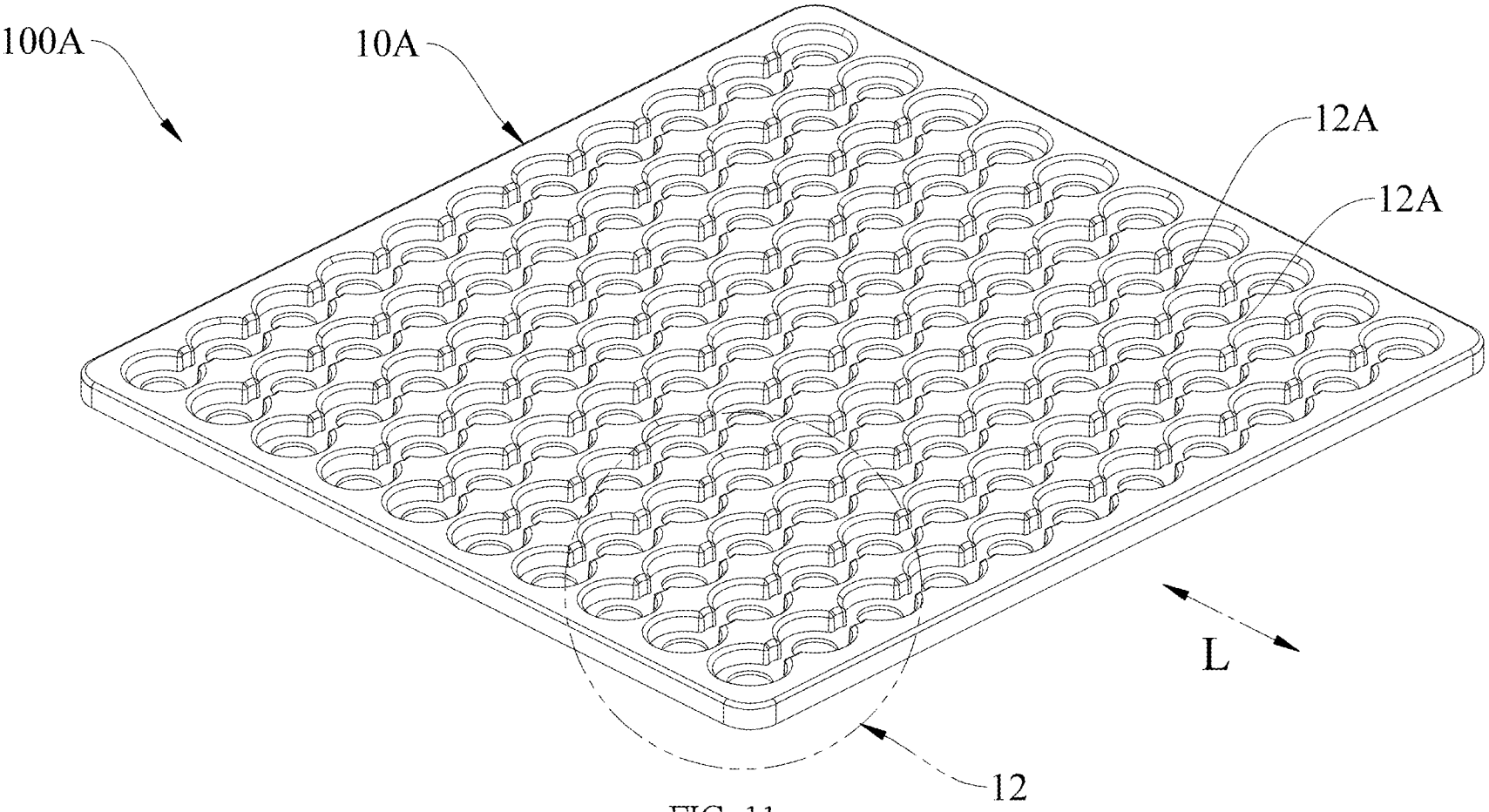
FIG. 11 is a perspective view of a second preferred embodiment of the present invention.
Figure 12:
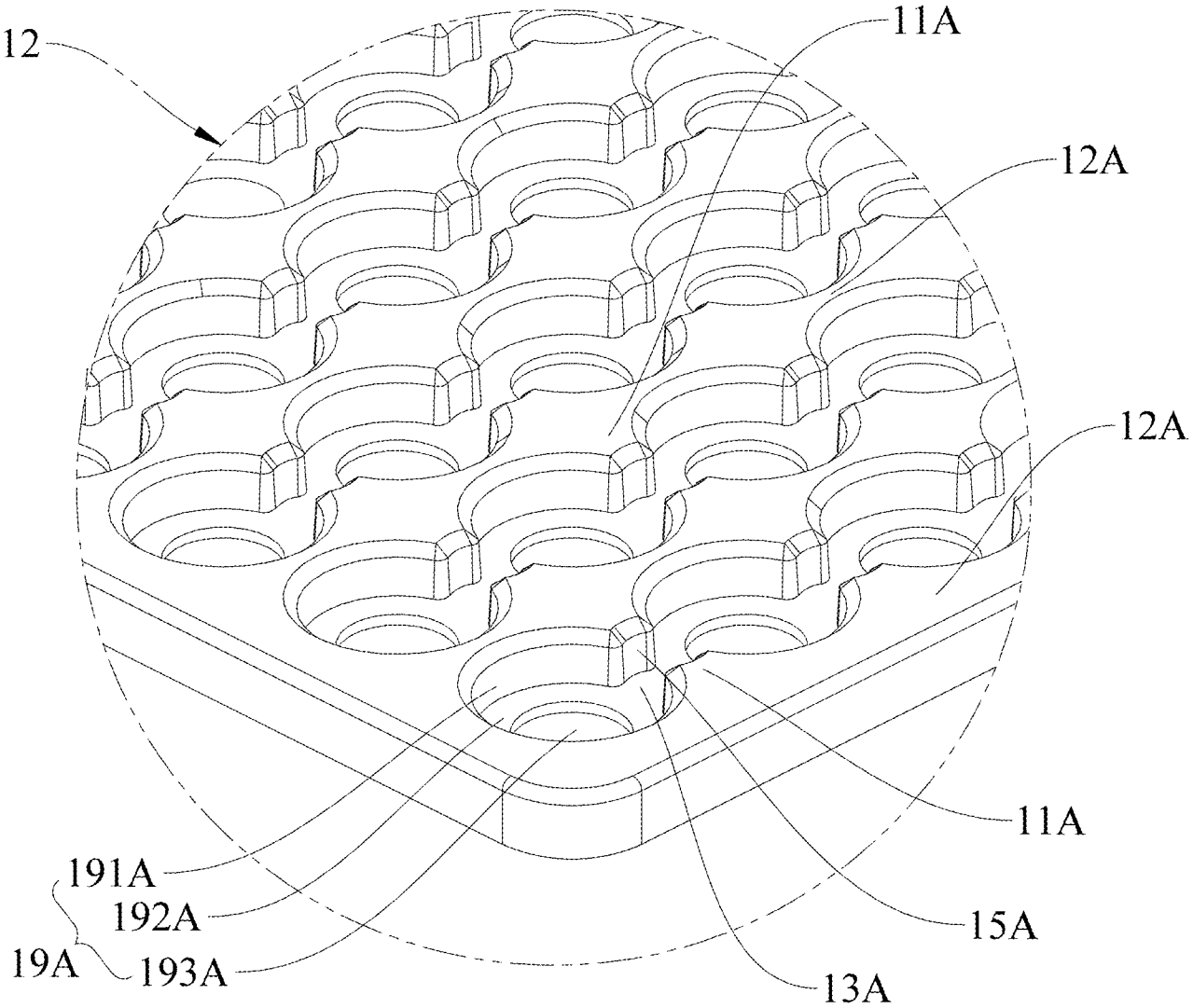
FIG. 12 is an enlarged view of a marked region 12 in FIG. 11.
Figure 13:
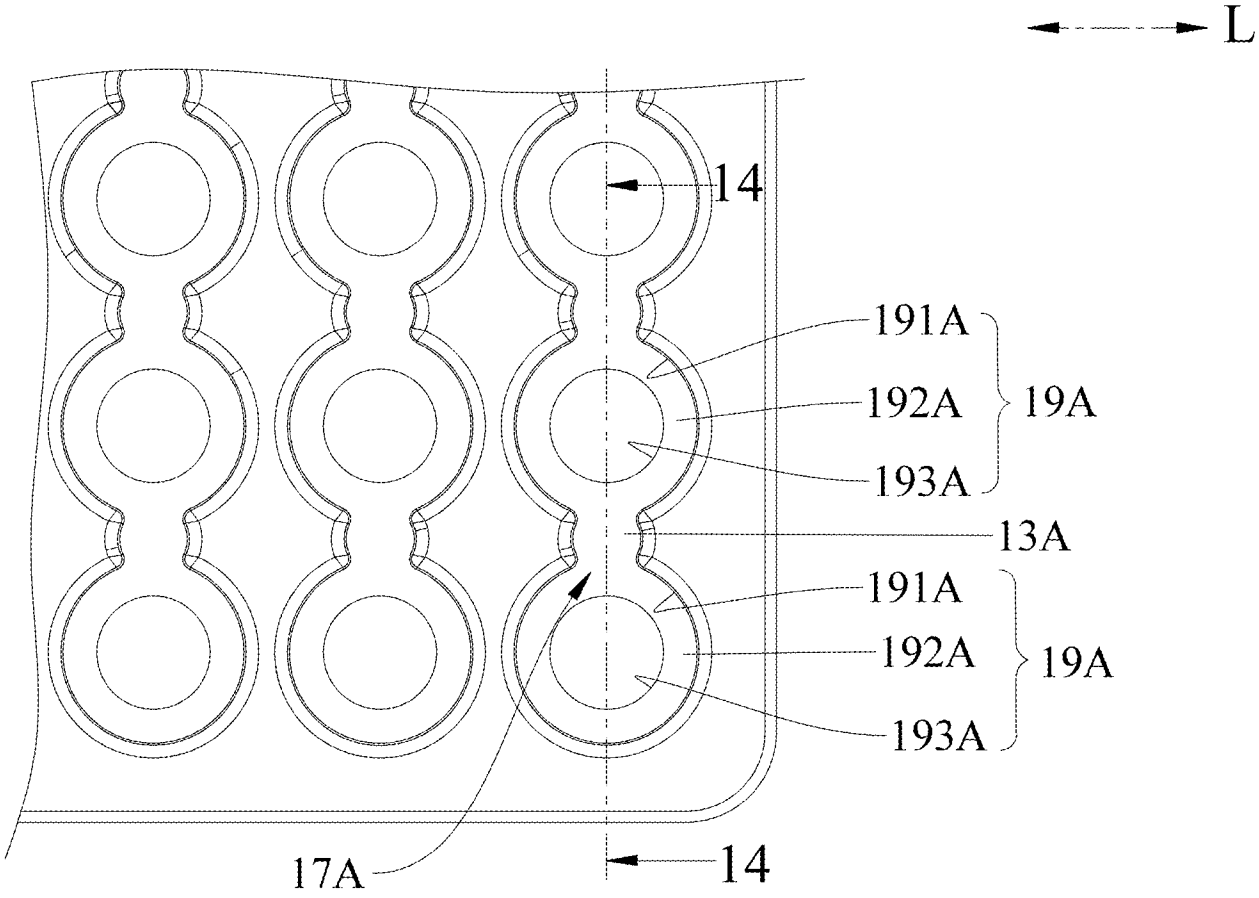
FIG. 13 is a partially enlarged top view of the second preferred embodiment of the present invention.

The effect of the present invention is that two of the plurality of pickup grooves 19 can accommodate the user's fingertips, and the two sides of the RFID particle 20 (as shown in FIG. 3, corresponding to the two sides of the electronic device shape P) protrude from two of the plurality of pickup grooves 19 communicating with two sides of one of the plurality of accommodating portions 17, so that when the user inserts the RFID particle 20 into one of the plurality of accommodating portions 17, or takes the RFID particle 20 from one of the plurality of accommodating portions 17 with the index finger and thumb, the fingertips will not be hindered by the structure around the plurality of accommodating portions 17, allowing the user to quickly put the RFID particles 20 into the plurality of accommodating portions 17 for positioning or to quickly remove the RFID particles 20 stored on the plurality of accommodating portions 17.

In other preferred embodiments, the two sides of the electronic device located in each accommodating portion 17 may not protrude from the two of the plurality of pickup grooves 19. At this time, the two of the plurality of pickup grooves 19 can still be inserted by the user's fingertips. The user can quickly take out the electronic device from each accommodating portion 17 or put the electronic device into each accommodating portion 17 by picking up the electronic device with the fingers, such as the index finger and thumb. In addition to picking up the electronic device and putting the electronic device into each accommodating portion 17 with the user's hands, or taking out the electronic device positioned therein from each accommodating portion 17 with the user's hands, the user can also use a mechanical device, such as an actuator on an end of a robot arm, to clamp the electronic device for putting the electronic device into each accommodating portion 17, or taking out the electronic device positioned therein from each accommodating portion 17.

In addition to the above-mentioned first preferred embodiment of the present invention forms each recess 192 on the bottom side of each pickup groove 19 for accommodating the user's fingertips, each pickup groove 19 can also be designed to have a bottom having a perforation. Please refer to a second preferred embodiment of the present invention shown in FIGS. 11 to 15. An electronic device carrier tray 100A has a tray body 10A. The tray body 10A also has a plurality of support ribs 12A. The plurality of support ribs 12A are spaced apart and parallel, a restriction direction L is defined on the tray body 10A, and the restriction direction L is perpendicular to the plurality of support ribs 12A. A plurality of pairs of convex portions 11A protrudes from any two adjacent support ribs of the plurality of support ribs 12A. Two restriction surfaces 15A are respectively formed on two opposite surfaces of two convex portions 11A in each pair of convex portions 11A. Each restriction surface 15A is an arcuate surface. A supporting surface 13A is formed on a bottom side between two convex portions of each pair of the plurality of pairs of convex portions 11A, and an accommodating portion 17A is formed between the two restriction surfaces 15A and the supporting surface 13A of each pair of convex portions 11A.

In conjunction with each accommodating portion 17A, there are a plurality of pickup grooves 19A between any two adjacent support ribs 12A of the plurality of support ribs 12A, and two pickup grooves 19A of the plurality of pickup grooves 19A communicate with two sides of each accommodating portion 17A. In this preferred embodiment, each pickup groove 19A is circular and forms two arcuate surfaces 191A opposite to each other. A flat plate portion 192A is connected between two bottom edges of the two arc surfaces 191A. Each flat plate portion 192A has a finger hole 193A in a middle of each flat plate portion 192A, and two sides of each supporting surface 13A are connected to two of the flat plate portions 192A. In the second preferred embodiment, a maximum aperture of each pickup groove 19A along the restriction direction L is also larger than a maximum length of each accommodation portion 17A along the restriction direction L, which means that a diameter of each pickup groove 19A is greater than a length between two centers of the two opposite restriction surfaces 15A.

Figure 14:
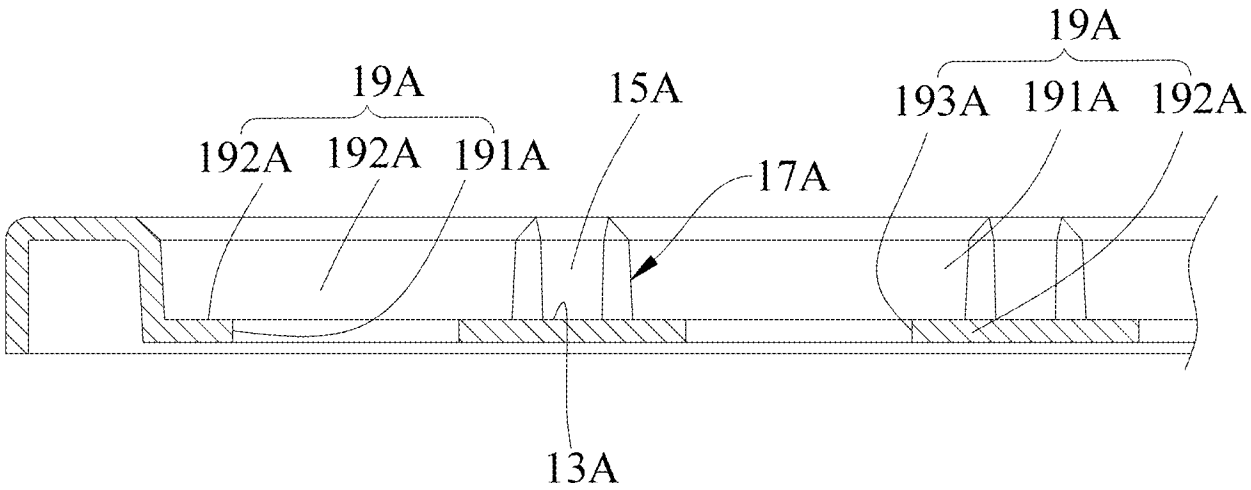
FIG. 14 is a sectional schematic view along the 14-14 line in FIG. 13.
Figure 15:
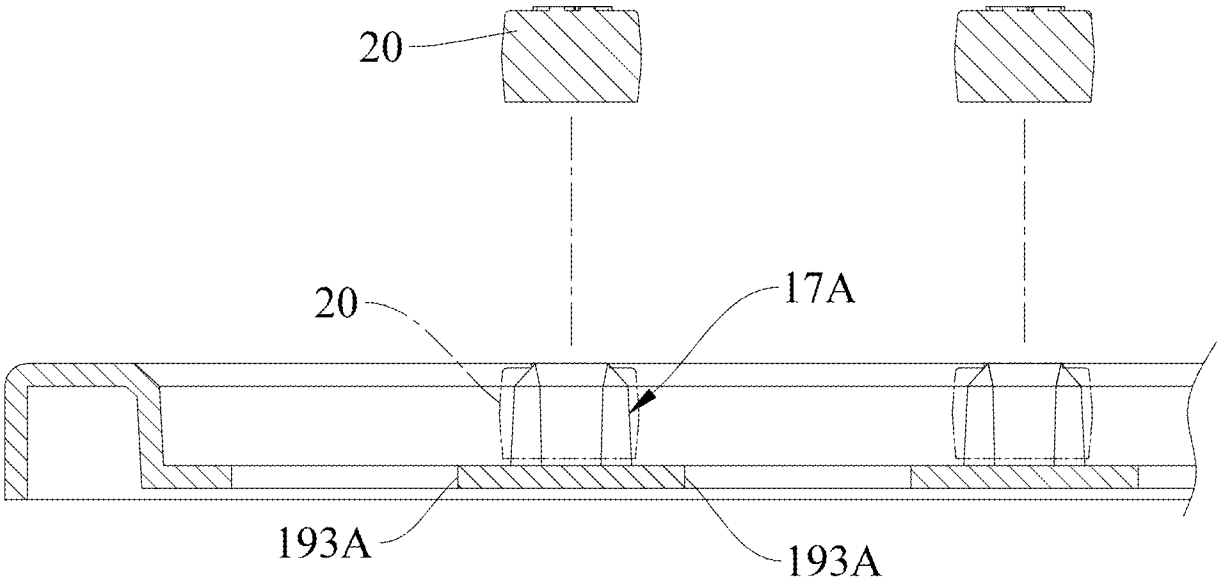
FIG. 15 is a schematic diagram of the action of inserting the RFID particles of the second preferred embodiment of the present invention.

Referring to FIG. 14 and FIG. 15, in the second preferred embodiment, when the user picks up an RFID particle 20 with fingers, such as the index finger and thumb, and places the RFID particle 20 in one of the plurality of accommodating portions 17A, two pickup grooves 19A of the plurality of pickup grooves 19A communicate with two sides of each accommodating portions 17A, and each of the two pickup grooves 19A of the plurality of pickup grooves 19A has a finger hole 193A for the user's fingertips to pass through, thereby avoiding a movement of the user's fingertips from being obstructed by structures around each accommodating portion 17A. In this way, the user can quickly take out the electronic device form each accommodating portion 17A or put the electronic device into each accommodating portion 17A. In addition, since the remaining structures and functions of the second preferred embodiment of the present invention are the same as those described in the first preferred embodiment, they will not be described again here.

It must be pointed out that the embodiments described above are only some preferred embodiments of the present invention. All equivalent structures which employ the concepts disclosed in this specification and the appended claims should fall within the scope of the present invention.

What is claimed is:

1. An electronic device carrier tray, comprising:

a tray body, wherein the tray body has a plurality of support ribs, and the plurality of support ribs are spaced apart and parallel; a restriction direction is defined on the tray body, and the restriction direction is perpendicular to the plurality of support ribs; the tray body has a plurality of accommodating portions between any two adjacent support ribs of the plurality of support ribs, and the tray body has a plurality of pickup grooves between any two adjacent support ribs of the plurality of support ribs; two sides of each accommodating portion respectively communicate with two pickup grooves of the plurality of pickup grooves, and a maximum aperture of each pickup groove in the restriction direction is greater than a maximum length of each accommodating portion in the restriction direction, wherein a plurality of pairs of convex portions is provided between any two adjacent support ribs of the plurality of support ribs, and each pair of convex portions protrudes from any two adjacent support ribs of the plurality of support ribs and faces each other; each accommodating portion is formed between two convex portions of each pair of convex portions, and a bottom side between two convex portions of each pair of convex portions forms a supporting surface; two restriction surfaces are respectively formed on two opposite surfaces of two convex portions in each pair of convex portions, and a central portion of each of the two restriction surfaces is more concave than two sides of each restriction surface, the two sides of each restriction surface adjacent to each pickup groove, wherein each of the two restriction surfaces is an arcuate surface, and the two restriction surfaces, which face each other, of each pair of convex portions surround to form an electronic device shape; two sides of the electronic device shape respectively extend into two pickup grooves of the plurality of pickup grooves communicating with each accommodating portion, wherein a portion of each of the two restriction surfaces adjacent to each pickup groove forms a rounded corner portion, a top edge of each of the two restriction surfaces forms a chamfer.

2. The electronic device carrier tray as claimed in claim 1, wherein each pickup groove is circular, and each pickup groove forms two arcuate surfaces opposite to each other.

3. The electronic device carrier tray as claimed in claim 2, wherein a recess is connected between two bottom edges of the two arcuate surfaces; two sides of the supporting surface are respectively connected to an edge of two of the recesses.

4. The electronic device carrier tray as claimed in claim 2, wherein a plurality of flat plate portions is provided, each flat plate portion is connected between two bottom edges of the two arcuate surfaces, and a finger hole is provided in a middle of each flat plate portion; two sides of the supporting surface are connected to two flat plate portions of the plurality of flat plate portions.

5. The electronic device carrier tray as claimed in claim 1, wherein each support rib has two ends, one of the two ends of each support rib is connected to a first rib, and the other end of each support rib is connected to a second rib; a side wall is formed around the tray body, and the side wall is connected with the first rib and the second rib.

* * * * *